US010451221B2

(12) United States Patent
Gaddis et al.

(10) Patent No.: US 10,451,221 B2
(45) Date of Patent: Oct. 22, 2019

(54) INTERCHANGEABLE DOSING ARM DEVICE, SYSTEM AND METHOD

(71) Applicant: Chart Inc., Garfield Heights, OH (US)

(72) Inventors: Nathan Daniell Gaddis, Jasper, GA (US); James Robert Hight, Jr., Suwanee, GA (US); Bryson Tyler Jones, Marietta, GA (US); Peter Zhi Ng, San Bruno, CA (US)

(73) Assignee: Chart Inc., Ball Ground, GA (US)

( * ) Notice: Subject to any disclaimer, the term of this patent is extended or adjusted under 35 U.S.C. 154(b) by 0 days.

(21) Appl. No.: 15/787,859

(22) Filed: Oct. 19, 2017

(65) Prior Publication Data

US 2018/0119884 A1 May 3, 2018

Related U.S. Application Data

(60) Provisional application No. 62/409,980, filed on Oct. 19, 2016.

(51) Int. Cl.
*F17C 9/02* (2006.01)
*F17C 3/08* (2006.01)
(Continued)

(52) U.S. Cl.
CPC ..... *F17C 9/02* (2013.01); *F17C 3/08* (2013.01); *F17C 7/02* (2013.01); *F17C 13/04* (2013.01);
(Continued)

(58) Field of Classification Search
CPC .... F17C 9/02; F17C 3/08; F17C 3/085; F17C 7/02; F17C 13/04; F17C 2203/0391;
(Continued)

(56) References Cited

U.S. PATENT DOCUMENTS 2,406,234 A * 8/1946 Marancik et al. ..... F16L 17/10 285/187
2,732,227 A * 1/1956 Kaiser ..... F16L 59/21 138/109

(Continued)

FOREIGN PATENT DOCUMENTS

WO WO 98/15772 A1 4/1998
WO WO 2006/110060 A1 10/2006

OTHER PUBLICATIONS

Notification of Transmittal of the International Search Report and Written Opinion of the ISA, for PCT Appl. No. PCT/US2017/057391 dated Jan. 11, 2018.

*Primary Examiner* — Paul R Durand
*Assistant Examiner* — Randall A Gruby
(74) *Attorney, Agent, or Firm* — Cook Alex Ltd.; R. Blake Johnston

(57) ABSTRACT

A doser for dispensing a cryogenic fluid includes a doser body configured to receive the cryogenic fluid. The dosing arm has a proximal end and a distal end and a central passage extending between the proximal and distal ends. Furthermore, the dosing arm is configured to receive cryogenic fluid from the doser body. A bayonet connection removably connects the proximal end of the dosing arm to the doser body. A dosing head is mounted to the distal end of the dosing arm and is configured to receive cryogenic fluid from the central passage of the dosing arm and to dispense the cryogenic fluid.

6 Claims, 11 Drawing Sheets

(51) Int. Cl.
*F17C 13/04* (2006.01)
*F17C 7/02* (2006.01)

(52) U.S. Cl.
CPC ..... *F17C 2201/032* (2013.01); *F17C 2203/0391* (2013.01); *F17C 2205/037* (2013.01); *F17C 2205/0355* (2013.01); *F17C 2221/014* (2013.01); *F17C 2223/013* (2013.01); *F17C 2223/0161* (2013.01); *F17C 2223/031* (2013.01); *F17C 2223/033* (2013.01); *F17C 2223/046* (2013.01); *F17C 2225/0161* (2013.01); *F17C 2225/033* (2013.01); *F17C 2227/0121* (2013.01); *F17C 2250/0621* (2013.01); *F17C 2265/06* (2013.01); *F17C 2270/059* (2013.01); *F17C 2270/0509* (2013.01)

(58) Field of Classification Search
CPC ... F17C 2203/0395; F16L 51/02; F16L 59/06; F16L 59/065
See application file for complete search history.

(56) References Cited

U.S. PATENT DOCUMENTS 3,016,717 A * 1/1962 Gottzmann ..... F04B 15/08 417/562
3,068,026 A * 12/1962 McKamey ..... F16L 39/005 285/123.1
3,134,237 A * 5/1964 Canty ..... F17C 3/02 220/560.03
3,270,769 A * 9/1966 Kaiser ..... F16L 59/065 137/375
3,272,579 A * 9/1966 Leonard ..... F17C 3/08 220/560.12
3,341,215 A * 9/1967 Spector ..... B60P 3/2295 105/358
3,423,955 A * 1/1969 Wright ..... F17C 3/085 62/51.1
3,433,028 A * 3/1969 Klee ..... F16L 59/141 62/50.7
3,446,388 A * 5/1969 Greenberg ..... F17C 13/086 220/560.04
3,483,709 A * 12/1969 Sayres ..... F17C 3/085 165/287
3,765,705 A * 10/1973 Tantam ..... F16L 59/065 138/114
3,782,128 A * 1/1974 Hampton ..... F17C 3/08 220/560.12
3,876,235 A * 4/1975 Flint ..... F16L 27/12 285/288.1
3,945,215 A * 3/1976 Johnson ..... F16L 51/02 62/50.7
3,972,202 A * 8/1976 Stearns ..... F17C 9/02 62/50.1
4,011,732 A * 3/1977 Doherty ..... F16L 39/005 285/148.2
4,036,617 A * 7/1977 Leonard ..... F16L 7/00 138/112
4,038,832 A * 8/1977 Lutgen ..... F17C 13/086 114/74 A
4,099,746 A * 7/1978 Kontsch ..... F16L 51/02 285/119
4,491,347 A * 1/1985 Gustafson ..... F16L 59/141 285/353
4,535,596 A * 8/1985 Laskaris ..... F17C 3/085 505/892
4,667,487 A * 5/1987 Miller ..... F25D 19/006 285/47
4,715,187 A * 12/1987 Stearns ..... F17C 9/00 62/50.1
4,745,760 A * 5/1988 Porter ..... F17C 3/085 62/50.2
4,877,153 A * 10/1989 Varghese ..... F17C 3/08 220/560.1
4,944,155 A * 7/1990 Alexander ..... F17C 3/08 62/268
5,131,429 A * 7/1992 Nixon ..... F16L 37/407 137/329.3
6,134,893 A * 10/2000 Bonn ..... F16L 27/0828 285/47
6,641,174 B2 * 11/2003 Klok ..... F16K 35/00 285/1
7,052,047 B1 * 5/2006 Box ..... F16L 37/248 285/123.15
7,431,058 B2 * 10/2008 Holting ..... B01J 19/0053 141/296
8,590,942 B2 * 11/2013 Kouketsu ..... F16L 39/005 285/123.12
9,688,927 B2 * 6/2017 Chen ..... C10J 3/86
9,828,987 B2 * 11/2017 Steffen ..... F04B 49/24
2005/0086949 A1 * 4/2005 Noble ..... F17C 3/08 62/50.1
2008/0169037 A1 * 7/2008 Ziegler ..... F16L 39/005 138/149
2018/0081011 A1 * 3/2018 Wikus ..... G01R 33/3804
2018/0112824 A1 * 4/2018 Gaddis ..... F17C 5/04

* cited by examiner

INTERCHANGEABLE DOSING ARM DEVICE, SYSTEM AND METHOD

CLAIM OF PRIORITY

This application claims the benefit of U.S. Provisional Application No. 62/409,980, filed Oct. 19, 2016, the contents of which are hereby incorporated by reference.

FIELD OF THE INVENTION

The present disclosure relates generally to cryogenic fluid dispensing systems and, in particular, to interchangeable dosing arms for cryogenic fluid dosers.

BACKGROUND

Cryogenic fluids, that is, fluids having a boiling point generally below −150° C. at atmospheric pressure, are used in a variety of industrial applications. One example is in the packaging of food, beverages and other products.

One part of liquid nitrogen (a cryogenic fluid) warms and expands into 700 parts of gaseous nitrogen at ambient temperature. Based on this characteristic, automated dosing equipment and systems have been developed that precisely dispense measured doses of liquid nitrogen into product containers prior to sealing. The trapped liquid nitrogen vaporizes and thus creates pressure within the container so as to add rigidity to the container. This allows for a use of a thinner container wall which reduces material costs and weight. Alternatively, for preservation and modified packaging (MAP) applications, the rapidly expanding gas is allowed to escape before the product packaging is sealed, flushing out oxygen and extending product life. In still another application, a dose of liquid nitrogen is introduced to "lock in" and surface freeze the food product (such as novelty ice cream).

A typical prior art dosing system is illustrated in FIG. 1. The liquid nitrogen is stored in a vacuum-insulated bulk tank 20 and transferred, via vacuum-insulated piping 22, to a phase separator 24. Liquid nitrogen is then provided via line 26 to a doser, indicated in general at 28. The doser includes a doser body 30 which houses an insulated cryogen source reservoir that receives the liquid nitrogen from line 26. A dosing arm 32 is connected to the doser body 30 and is in communication with the cryogen source reservoir. A dosing head 34 is positioned on the distal end of the dosing arm. The dosing arm 32 includes vacuum-insulated piping so that liquid nitrogen is supplied from the cryogen source reservoir of the doser body to the dosing head 34. A conveyer of a product packaging system passes below the dosing head. The dosing head includes a valve that dispenses or injects droplets including very precise amounts of liquid nitrogen into product containers as they pass below the dosing head on the conveyer.

Prior art dosers use a fixed dosing arm extending from the doser body. This requires a number of different doser models to accommodate user applications requiring various arm lengths. Furthermore, dosers with fixed dosing arms increase the difficulty and cost in developing custom built solutions for accommodating user needs.

SUMMARY

There are several aspects of the present subject matter which may be embodied separately or together in the devices and systems described and claimed below. These aspects may be employed alone or in combination with other aspects of the subject matter described herein, and the description of these aspects together is not intended to preclude the use of these aspects separately or the claiming of such aspects separately or in different combinations as set forth in the claims appended hereto.

In one aspect, a doser for dispensing a cryogenic fluid features a doser body configured to receive the cryogenic fluid. A dosing arm has a proximal end and a distal end with a central passage extending between the proximal and distal ends and configured to receive cryogenic fluid from the doser body. A bayonet connection removably connects the proximal end of the dosing arm to the doser body. A dosing head is mounted to the distal end of the dosing arm and configured to receive cryogenic fluid from the central passage of the dosing arm and to dispense the cryogenic fluid.

In another aspect, a doser for dispensing a cryogenic fluid features a doser body including a reservoir configured to receive the cryogenic fluid. An outlet fitting includes an outlet fitting outer jacket. An outlet fitting inner pipe is positioned within the outlet fitting outer jacket. The outlet inner pipe is in fluid communication with the doser body reservoir. An outlet fitting sleeve is connected to the outlet fitting outer jacket and inner pipe so that an annular space is defined between them. An outlet fitting flange is positioned on the outlet fitting sleeve. A male bayonet insertion stem is attached to the outlet fitting sleeve and is in fluid communication with the outlet fitting inner pipe. A dosing arm has a proximal end and a distal end. The dosing arm also includes a dosing arm outer jacket with a dosing arm inner pipe positioned within the dosing arm outer jacket. The dosing arm inner pipe has a central passage. A dosing arm sleeve is connected to the dosing arm outer jacket and inner pipe so that a sealed annular space is defined. The annular space is generally evacuated of air. A dosing arm flange positioned on the dosing arm sleeve and is removably attached to the outlet fitting flange. The male bayonet insertion stem is removably positioned within and in fluid communication with the central passage of the dosing arm inner pipe. A dosing head is mounted to the distal end of the dosing arm and is configured to receive cryogenic fluid from the central passage of the dosing arm inner pipe to dispense the cryogenic fluid.

In yet another aspect, a dosing arm includes a dosing arm outer jacket. A dosing arm inner pipe is positioned within the dosing arm outer jacket and has a central passage. A dosing head is positioned on a distal end of the dosing arm and is configured to receive a cryogenic fluid from the central passage. A dosing arm sleeve is connected to the dosing arm outer jacket and inner pipe at a proximal end of the dosing arm so that a sealed annular space is defined between them. The annular space is generally evacuated of air. A dosing arm flange is positioned on the dosing arm sleeve.

In yet another aspect, a method of changing a dosing arm of a doser includes the steps of disconnecting flanges of a male bayonet connector and a first female bayonet connector, where the male bayonet connector is attached to a doser body of the doser and the first female bayonet connector is attached to a first dosing arm, removing an insertion stem of the male bayonet connector from a central passage of the first female bayonet connector, inserting the insertion stem into a central passage of a second female bayonet connector of a second dosing arm, and connecting the flanges of the male bayonet connector and the second female bayonet connector.

In yet another aspect, a method of changing a dosing arm of a doser includes the steps of disconnecting flanges of a first male bayonet connector and a female bayonet connector, where the first male bayonet connector is attached to a first dosing arm and the female bayonet connector is attached to the doser body of the doser, removing an insertion stem of the first male bayonet connector from a central passage of the female bayonet connector, inserting an insertion stem of a second dosing arm into the central passage of the female bayonet connector, and connecting the flanges of the second male bayonet connector and the female bayonet connector.

DETAILED DESCRIPTION OF EMBODIMENTS

Embodiments of the invention provide an interchangeable dosing arm. The Interchangeable dosing arm is a fully modular design that has a female cryogenic bayonet inlet to simplify the construction of the doser while increasing flexibility with regard to user applications. The arm is vacuum jacketed independently from the body, and can receive several different styles of dosing actuators. It can be made in various lengths to cover a variety of standard applications, while also providing the ability to be customized based on individual user needs.

While the invention is described below in terms of dosers and systems for dosing that inject droplets of liquid nitrogen into product packaging, it may be used with other types of dosing systems and cryogenic fluids. In addition, while the dosing arm is described in terms of a dosing arm including a single dosing head, alternative embodiments could include multiple dosing heads mounted on a single dosing arm.

Figure 1:
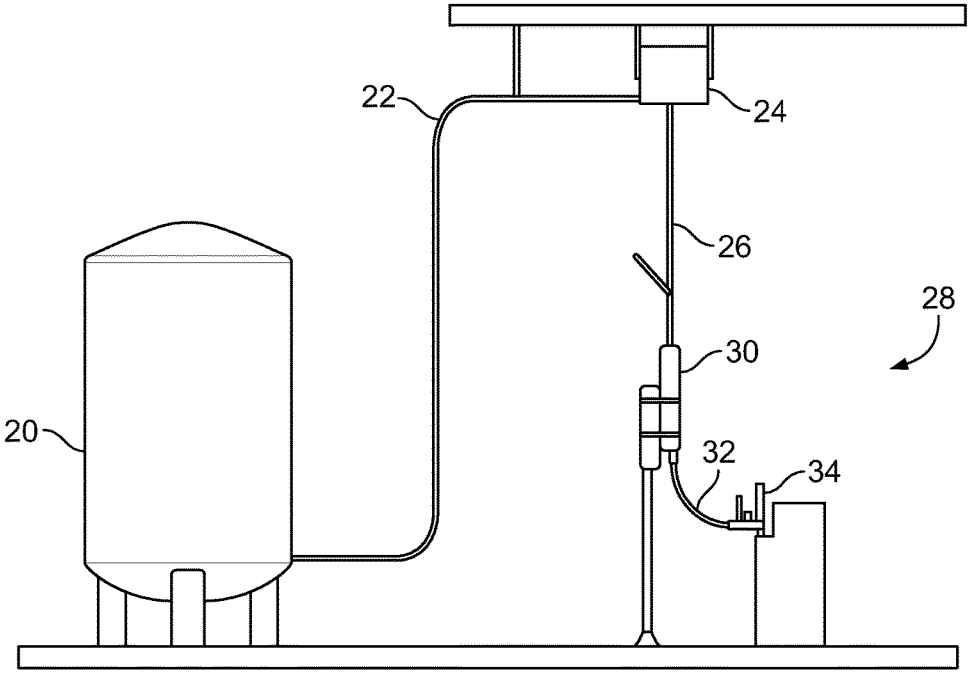
FIG. 1 Prior Art
FIG. 1 is a schematic view of a prior art dosing system.
Figure 2:
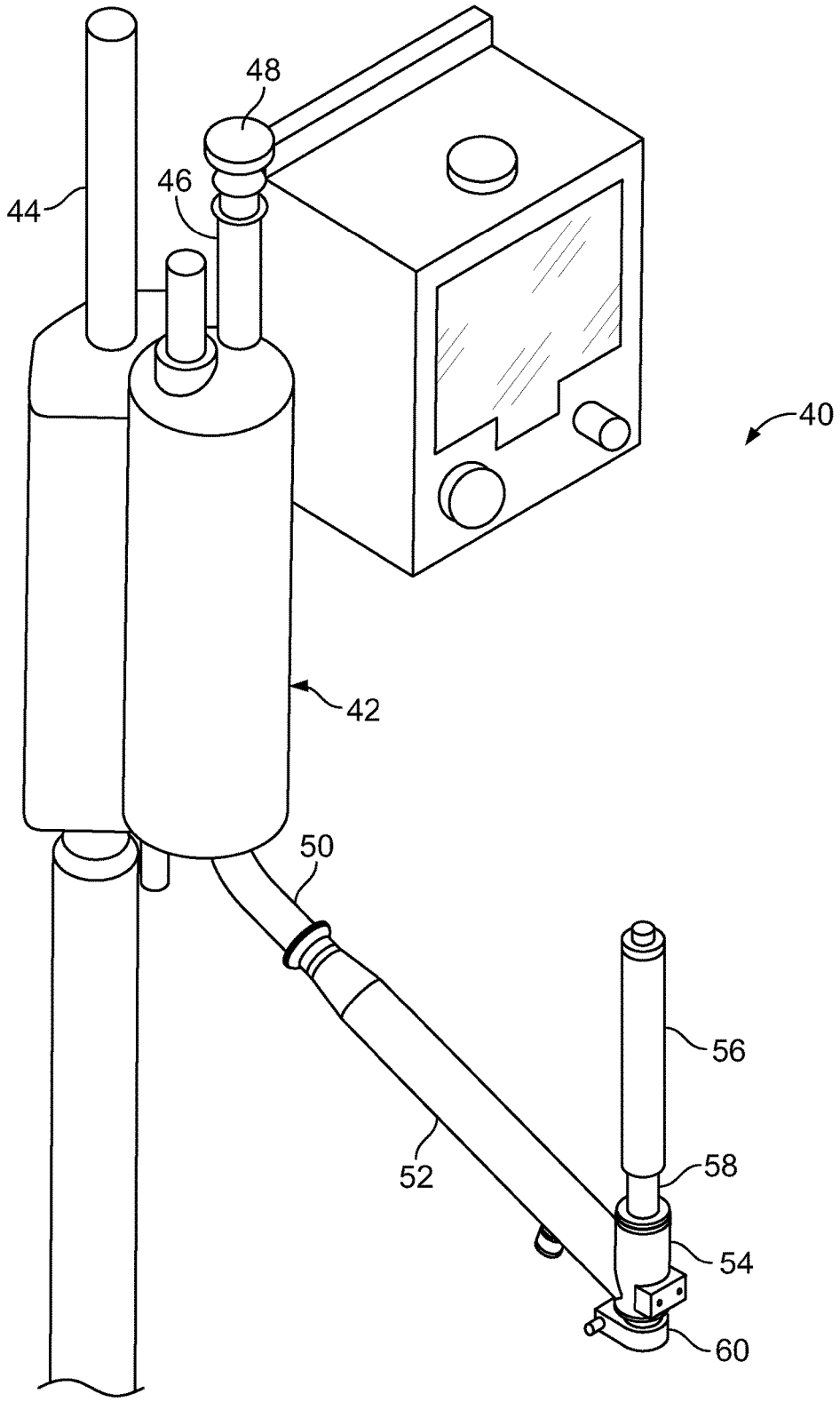
FIG. 2 is a perspective view of an embodiment of a doser.

A doser including an embodiment of the interchangeable dosing arms of the invention is indicated in general at 40 in FIG. 2. The doser includes a doser body 42 mounted upon a column 44 of a stand. The doser body, as described previously with reference to FIG. 1, receives liquid nitrogen via inlet fitting 46 that is attached to a liquid nitrogen supply line via clamp 48 (also shown in FIGS. 3 and 4).

Figure 3:
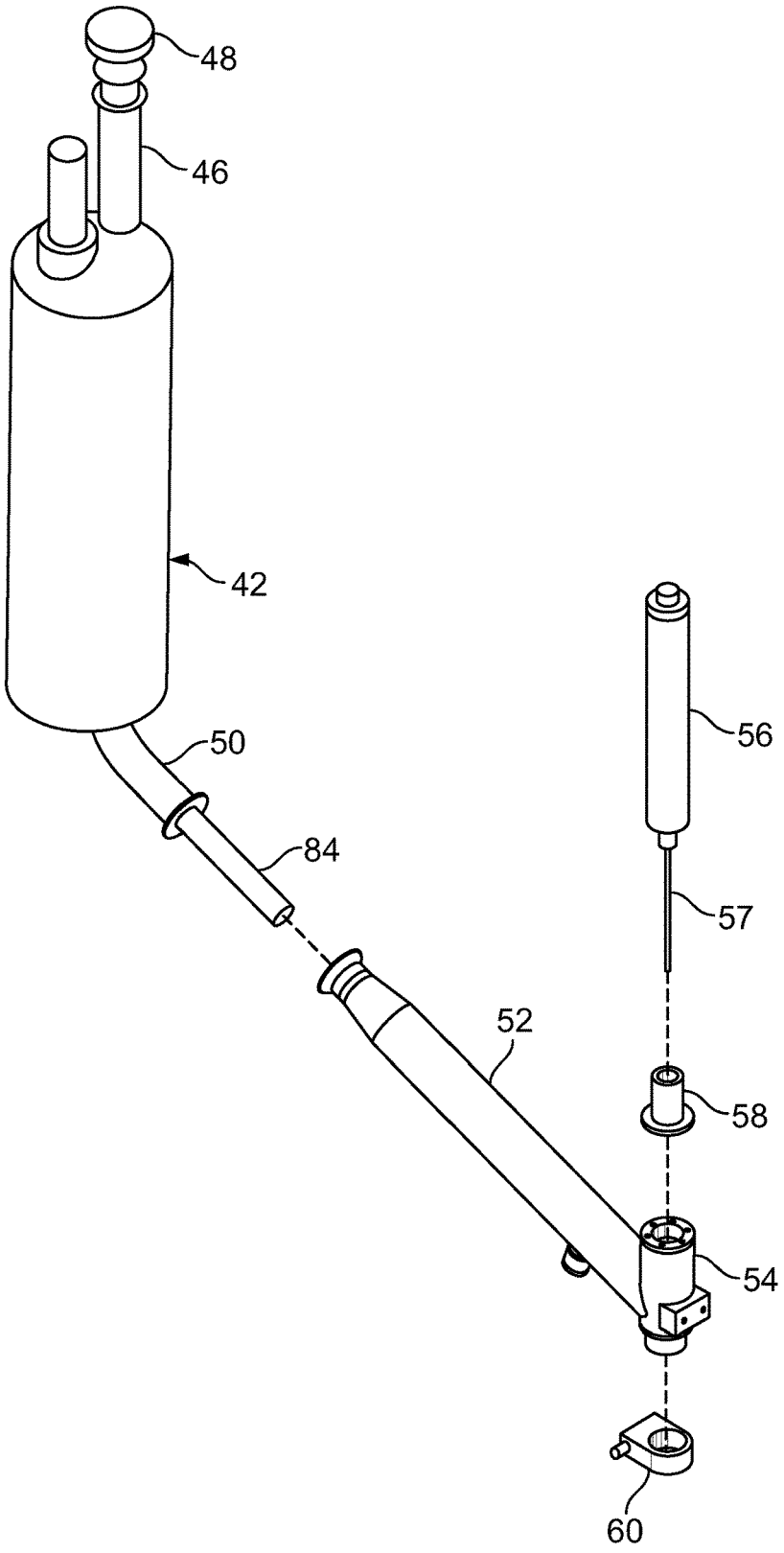
FIG. 3 is an exploded view of the doser of FIG. 2.

With reference to FIGS. 2 and 3, a vacuum insulated gooseneck shaped outlet fitting 50 exits the bottom of the doser body and, as described in greater detail below, is attached via a bayonet connection to a vacuum insulated dosing arm 52. A dosing head 54 is positioned upon the distal end of the dosing arm and, as explained in greater detail below, houses a dosing valve. A dosing valve actuator 56 is mounted to the top of the dosing head 54 via an adaptor 58 and actuates valve stem 57 to open and close the dosing valve within the dosing head 54. As a result, droplets of liquid nitrogen are dispensed in very precise amounts through optional heater plate 60, which is attached to the bottom of the dosing head.

Figure 4:
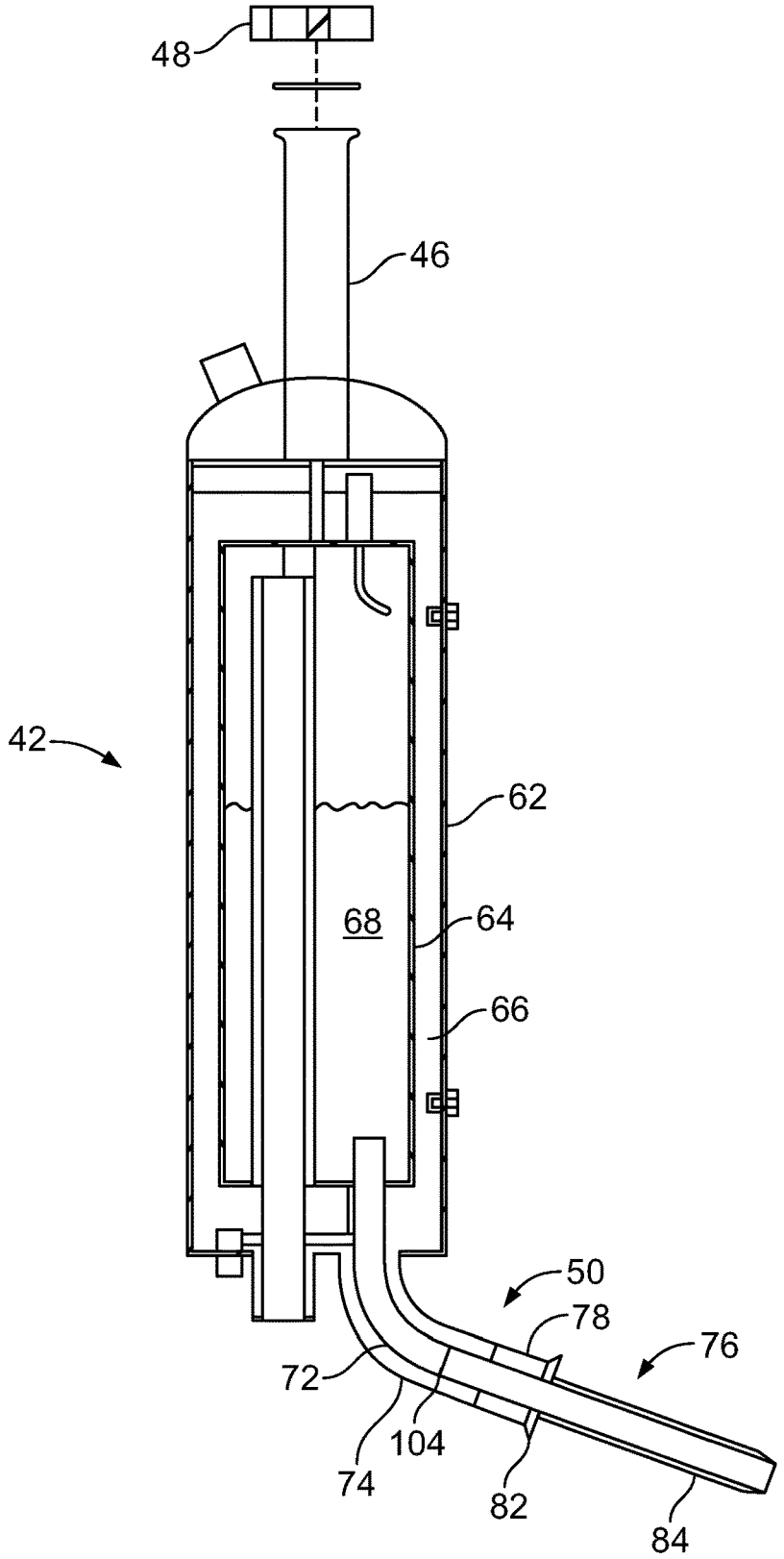
FIG. 4 is a cross sectional view of the doser body, outlet fitting and male bayonet connector of FIGS. 1-3.

With reference to FIG. 4, the doser body, indicated in general at 42, houses a vacuum insulated reservoir that receives the liquid nitrogen. More specifically, the doser body 42 includes an outer jacket 62 and an inner tank 64, with the space therebetween 66 evacuated of air so that the vacuum insulated reservoir is provided. A supply of liquid nitrogen 68 (received from inlet fitting 46) is stored within the inner tank 64. As an example only, further details regarding the construction of the doser body may be as illustrated in U.S. Pat. No. 6,182,715 to Ziegler et al., the contents of which are hereby incorporated by reference.

Figure 5A:
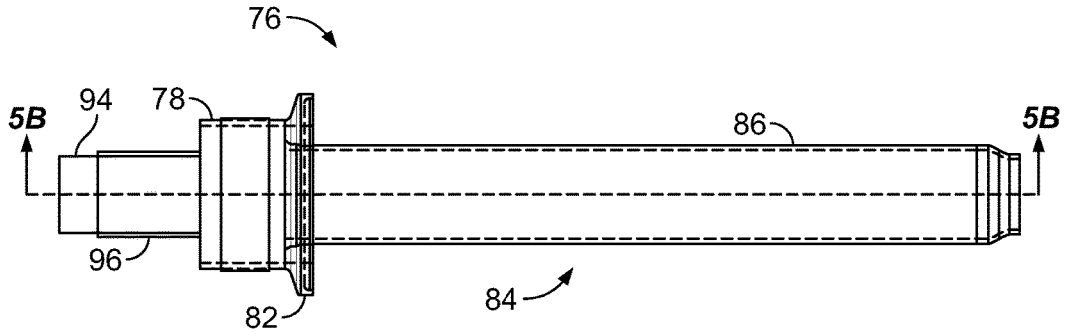
FIG. 5A is an enlarged view of the male bayonet connector of FIG. 4.
Figure 5B:
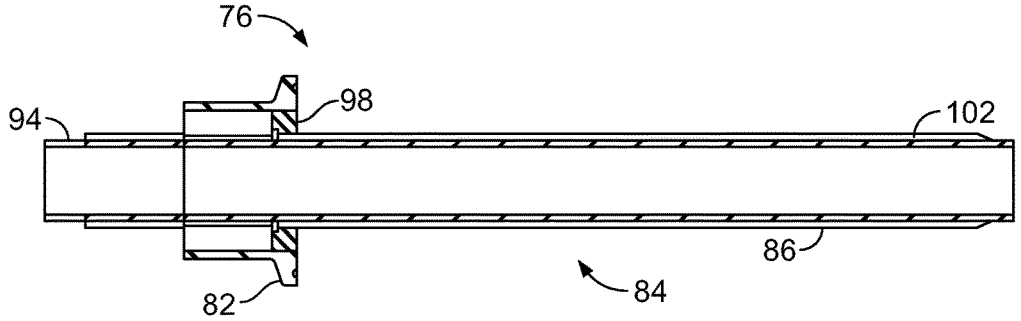
FIG. 5B is a cross sectional view of the male bayonet connector of FIG. 5A taken along line 5B-5B.

The doser body outlet fitting, indicated in general at 50 in FIG. 4, features an inner pipe 72 and an outer jacket 74. A male bayonet connector, indicated in general at 76 in FIGS. 4, 5A and 5B, is positioned at the distal end of the gooseneck shaped outlet fitting. The male bayonet connector includes a sleeve 78, which is circumferentially attached and sealed to outer jacket 74 by welding, brazing, adhesive or other arrangements known in the art. The sleeve 78 is provided with an annular flange 82. An insertion stem 84 extends from the sleeve flange.

Figure 6:
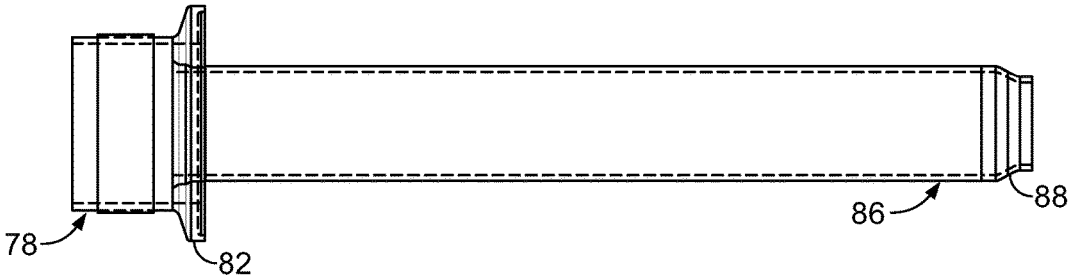
FIG. 6 is a side elevational view of the sleeve, flange and insertion stem outer jacket of the male bayonet connector of FIGS. 5A and 5B.

The insertion stem 84 of the male bayonet connector includes a tubular stem jacket, indicated at 86 in FIGS. 5A, 5B and 6. As illustrated in FIG. 6, the stem jacket 86 includes a circumferentially tapered distal tip portion 88. A male bayonet connector insert, indicated in general at 92 in FIG. 7, includes an inner pipe 94 which is optionally provided with a wrap 96. As examples only, the inner pipe 94 may be constructed from stainless steel, and the wrap 96 may be CRS WRAP available from Lydall, Inc. of Rochester, N.H. The insert 92 also includes a flange bushing 98, which may be made of, as examples only, 304 stainless steel or 16L stainless steel.

Figure 7:
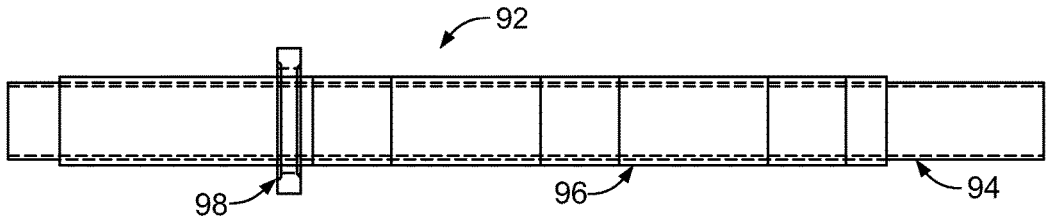
FIG. 7 is a side elevational view of the insert of the male bayonet connector of FIGS. 5A and 5B.

As illustrated in FIGS. 5A and 5B, the insert 92 of FIG. 7 is inserted through a central passage formed by the sleeve 78 and stem jacket 86 of FIG. 6. As a result, the flange bushing 98 is received within the sleeve 78 in a sealing fashion. The distal tip of the inner pipe is circumferentially attached and sealed to the tip of the taper distal tip portion 88 of the jacket 86 by welding, brazing, adhesive or other attachment arrangements known in the art. As a result, an annular insulation space, indicated at 102 in FIG. 5B is formed. As indicated at 104 in FIG. 4, the proximal end of the of the inner pipe 94 abuts the distal end of the inner pipe 72 of the outlet fitting 50 and is circumferentially attached and sealed thereto by welding, brazing, adhesive or other arrangements known in the art.

Figure 8:
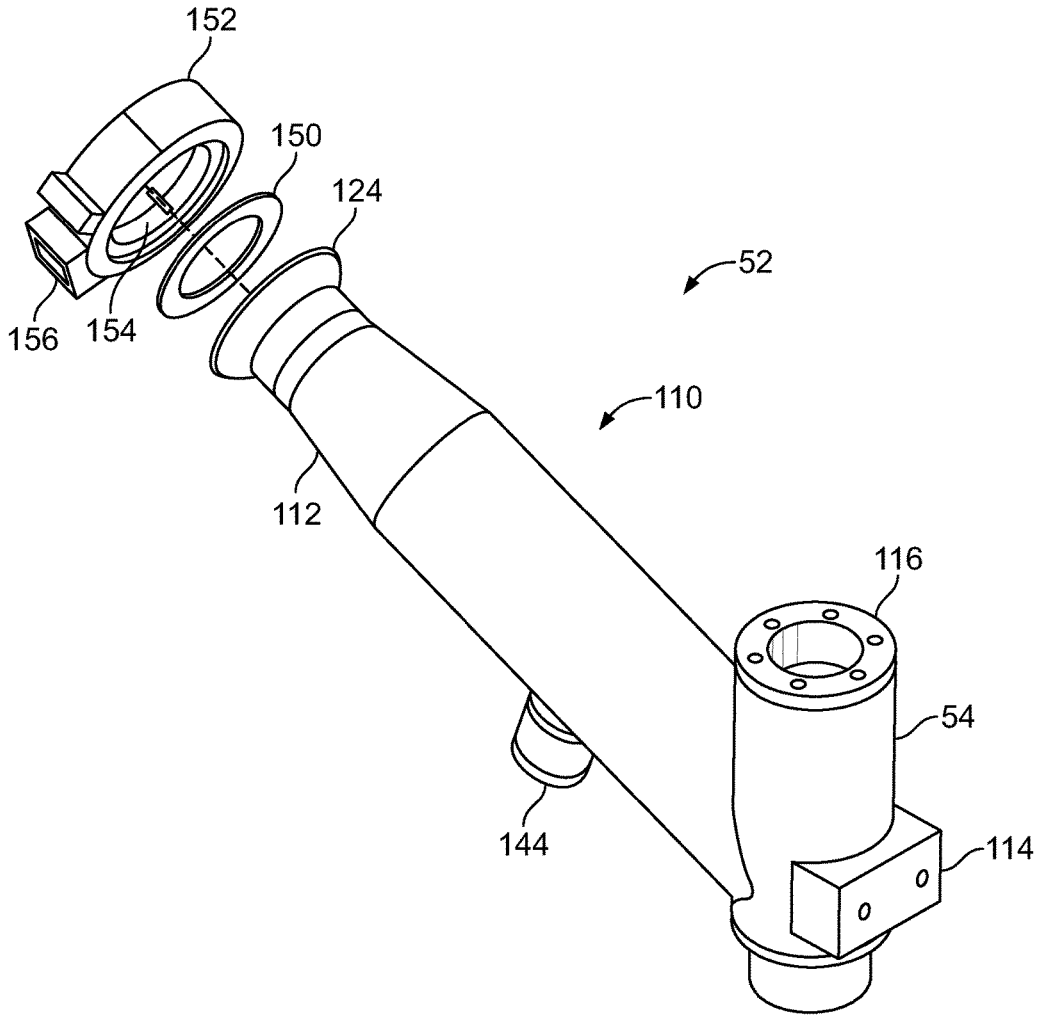
FIG. 8 is a perspective view of the dosing arm of FIGS. 2 and 3.
Figure 9:
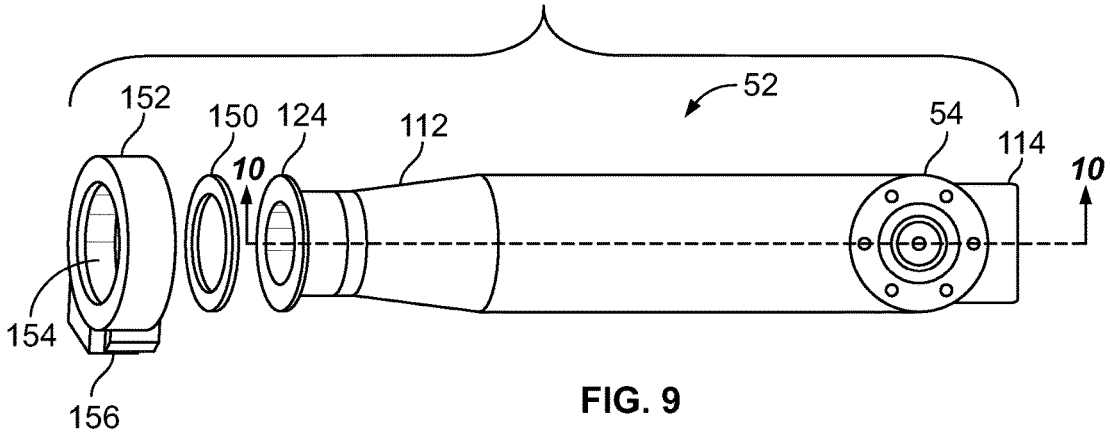
FIG. 9 is a top view of the dosing arm of FIG. 8.

Turning to FIGS. 8 and 9, the dosing arm of FIG. 2 is indicated in general at 52 and the dosing head is indicated at 54. The dosing arm 52 includes a dosing arm outer jacket, indicated in general at 110, that includes a circumferentially tapered proximal end portion 112. The distal end of the jacket 110 is circumferentially attached and sealed to the dosing head 54. An optional mounting bracket 114 is provided on the dosing head 54 to permit components to be attached for specialized applications. The top of the dosing head 54 includes a mount 116 for attaching the dosing actuator (such as 56 in FIG. 1). As noted previously, while a single dosing head 54 is illustrated, multiple dosing heads could instead be attached to the distal end of the dosing arm 52.

Figure 10:
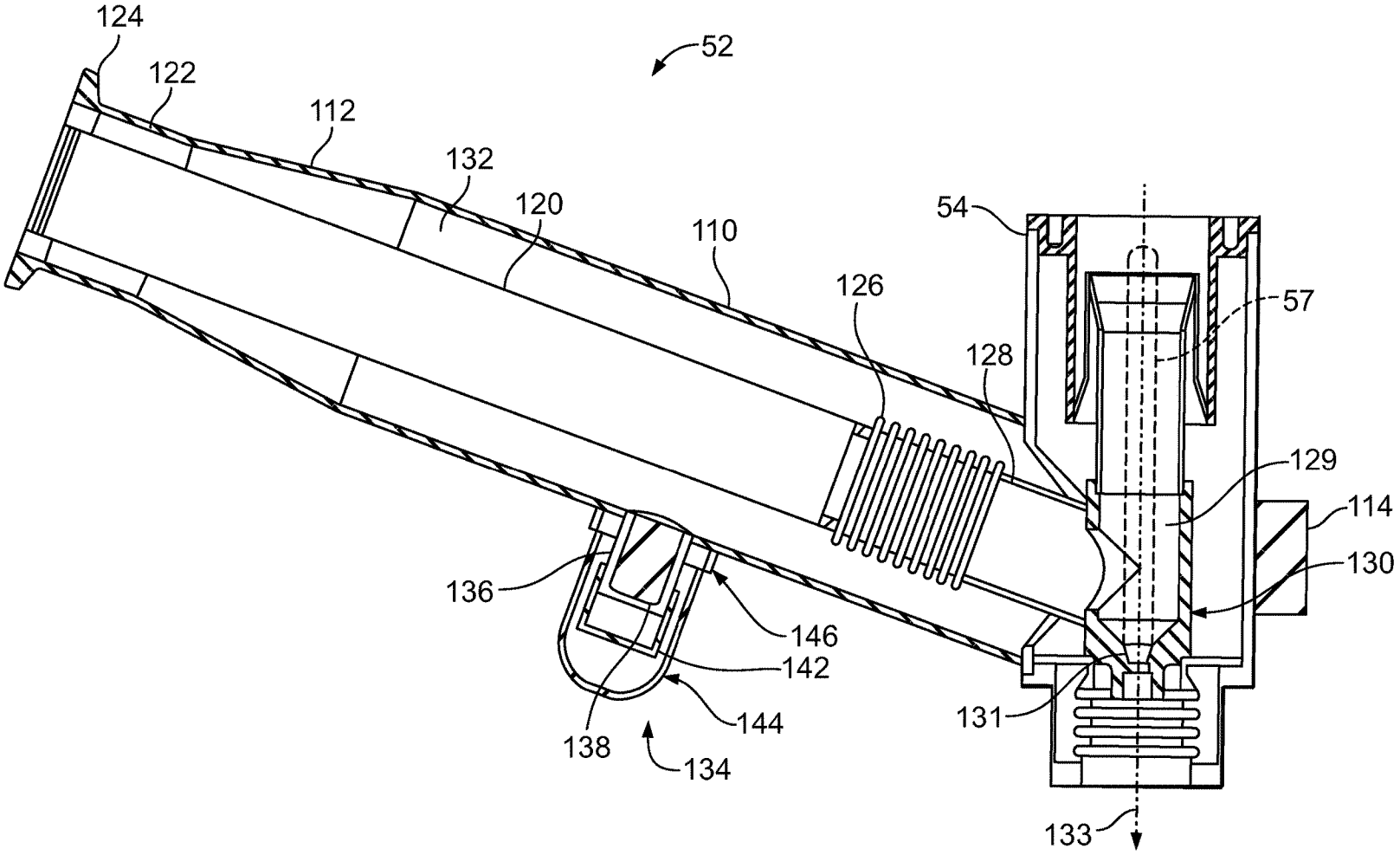
FIG. 10 is a cross sectional view of the doser of FIGS. 8 and 9 taken along line 10-10 of FIG. 9.
Figure 11:
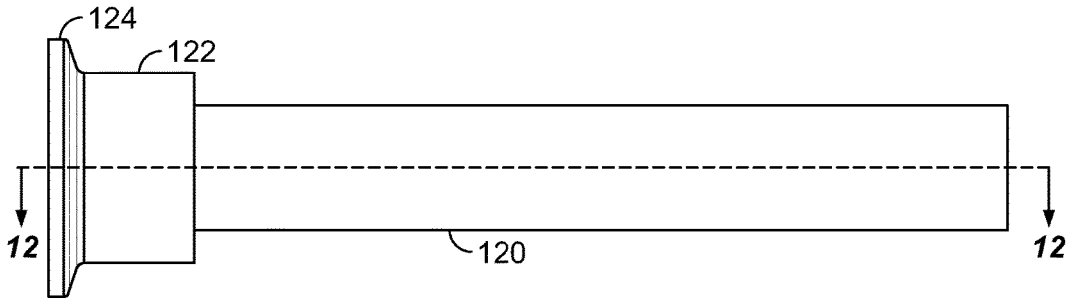
FIG. 11 is an enlarged side elevational view of the female bayonet connector of the dosing arm of FIG. 7-10.
Figure 12:
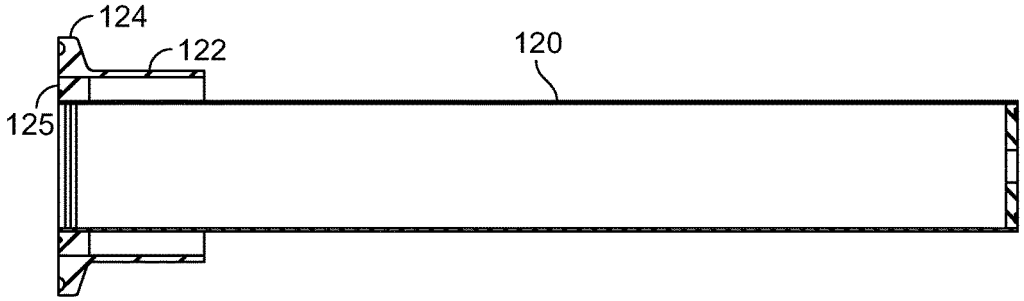
FIG. 12 is a cross sectional view of the female bayonet connector of FIG. 11 taken along line 12-12 of FIG. 11.

As illustrated in FIG. 10, a dosing arm inner pipe 120 is positioned within the outer jacket 110. As illustrated in FIGS. 11 and 12, a sleeve 122, including an annular flange 124, is circumferentially secured and sealed, via a flange bushing 125 (FIG. 12), to the proximal end of the inner pipe 120. As an example only, inner pipe 120 may be made of stainless steel. Flange bushing 125 may be made of, as examples only, 304 stainless steel or 316L stainless steel.

Returning to FIG. 10, the sleeve 122 of FIGS. 11 and 12 is circumferentially attached and sealed to the tapered end portion 112 of the outer jacket 110 by welding, brazing, adhesive or other attachment arrangement known in the art. A bellows 126 is attached by one end to the distal end of the inner pipe 120. A pipe section 128 joins the other end of the bellows to a valve body 130. The bellows accommodates thermal expansion of the inner pipe 120 as the cold liquid nitrogen flows, and ceases to flow, therethrough. Bellows 126 may be made of, as examples only, 304 stainless steel or 316L stainless steel.

With reference to FIG. 10, during use of the doser, liquid nitrogen flows into a supply chamber 129 defined by the valve body 130. A needle valve stem, shown in the closed position in phantom at 57, (also shown in FIG. 3) is manipulated by the dosing valve actuator (56 in FIGS. 2 and 3). When the dosing valve is opened, the valve stem 57 travels upward and away from valve seat 131. As a result, one or more droplets of liquid nitrogen from the supply chamber 129 pass out of the bottom of the dosing head 54, as indicated by arrow 133. Alternative embodiments of the dosing valve and head, and example details of the dosing valve actuator, are presented in U.S. Pat. No. 7,281,550 to Ziegler, the contents of which are hereby incorporated by reference, as well as in U.S. Pat. No. 6,182,715 to Ziegler et al., incorporated by reference previously.

The inner pipe 120 defines a central passage that is sized to receive the insertion stem 84 (FIGS. 3-5) of the male bayonet connector. As a result, a female bayonet connector is formed at the proximal end of the dosing arm 52.

An annular space 132 is defined between the inner pipe 120 and the outer jacket 110. A vacuum port assembly, indicated in general at 134 in FIG. 10, permits air to be evacuated from the annular space to provide the dosing arm with vacuum insulation. The vacuum port assembly includes a fitting 136 that defines a passage that is in fluid communication with the annular space 132. A sealing plug 138 is removably positioned within the fitting and is removed during evacuation of air from the annular space and replaced afterwards. A removable cap 142 engages the fitting 136 to cover the plug 138. A removable cover 144 engages a base 146 to protect the vacuum port assembly when not in use.

Figure 13:
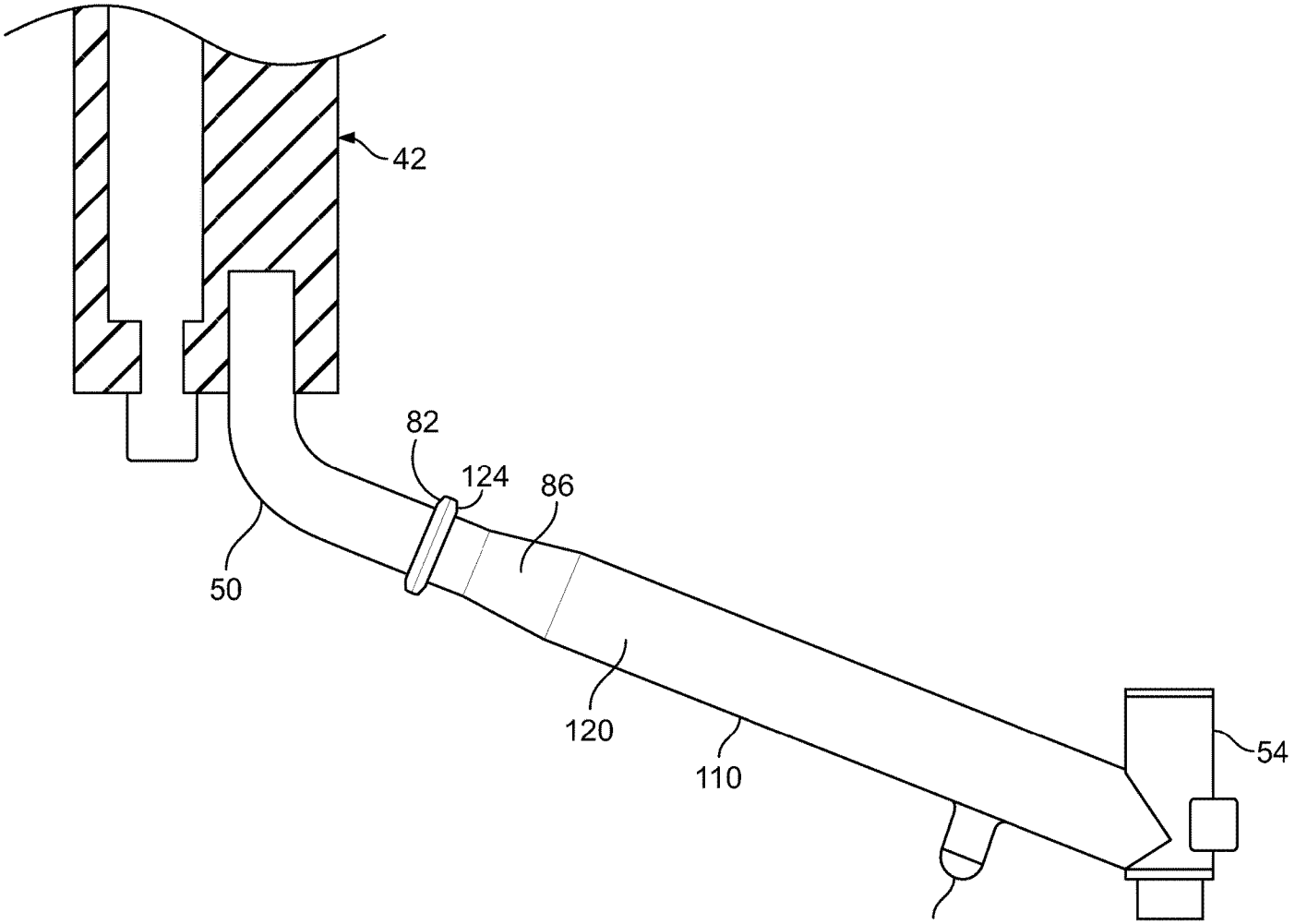
FIG. 13 is a cross sectional view of the joined male and female bayonet connectors of FIGS. 2-12.

As illustrated in FIG. 13, the male bayonet connection of FIGS. 3 and 4 is connected to the female bayonet connection of FIG. 10 by inserting the insertion stem 84 of the male bayonet connector into the central passage defined by the inner pipe 120 of the female bayonet connector. The insertion continues until the annular flange 82 of the male bayonet connector is positioned adjacent to the annular flange 124 of the female bayonet connector, as illustrated in FIG. 13. A bushing, indicated at 150 in FIGS. 8, 9 and 14A, is positioned between the annular flanges.

The bayonet connection is sealed together using the clamp indicated at 152 in FIGS. 8, 9, 14A and 14B. More specifically, as illustrated in FIGS. 8, 9, 14A and 14B, the clamp includes a central opening defined by an inner surface and an annular groove 154 formed in the inner surface. The clamp is constructed of a flexible material (such as metal) and may be closed to a reduced diameter and locked or unlocked and opened by manipulation of a latch or clasp 156. Suitable clamps are well known in the art.

Figure 14A:
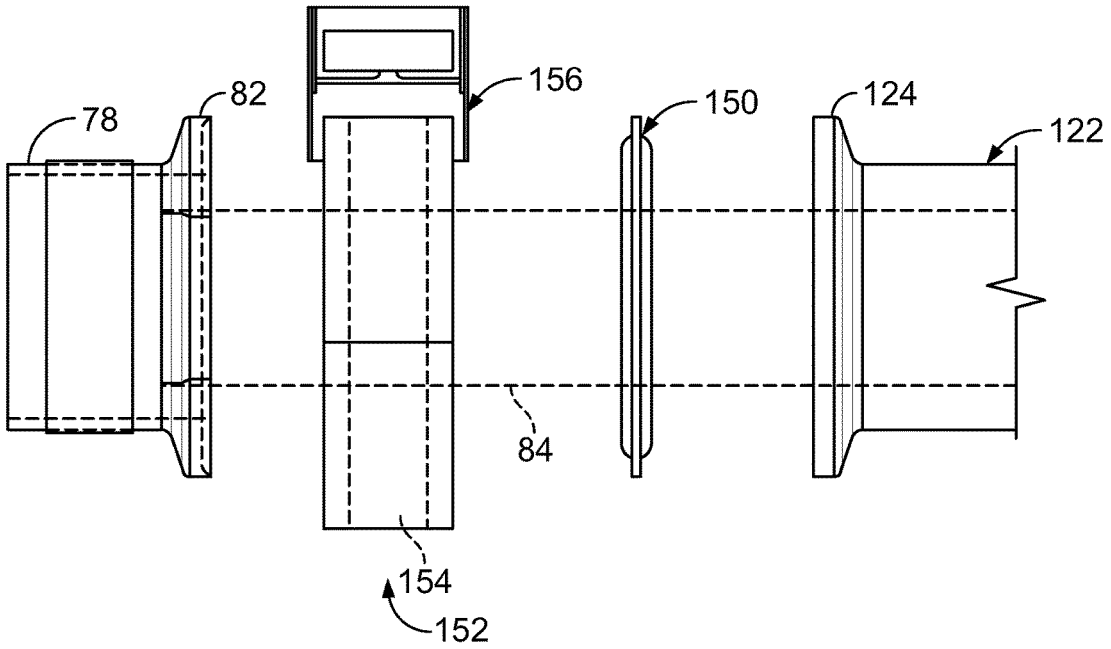
FIGS. 14A and 14B illustrate the male and female bayonet connector flanges, a bushing and a clamp prior to being joined (FIG. 14A) and after being joined and clamped (FIG. 14B)
Figure 14B:
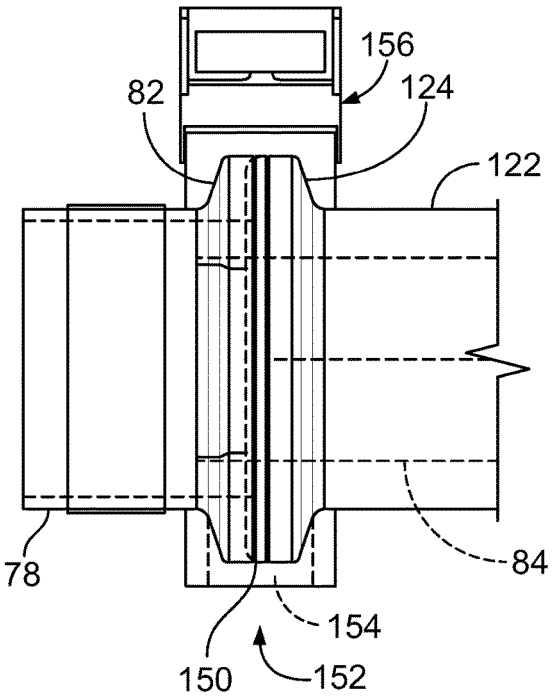

As illustrated in FIGS. 14A and 14B, the bayonet connection is locked in the configuration illustrated in FIG. 13 by placing the annular flanges 82 and 124 into the central opening of the clamp 152 with the gasket 150 positioned therebetween. The latch 156 of the clamp is then closed so that the flanges 82 and 124 are secured together within the annular groove 154 of the clamp with the gasket 150 compressed or sandwiched therebetween, as shown in FIGS. 14B and 15.

Other arrangements known in the art for securing the flanges of the male bayonet connector and the female bayonet connector may alternatively be used in place of the illustrated clamp. As an example only, the flanges may be secured together by fasteners, such as bolts, that pass through openings formed in the flanges.

In an alternative embodiment, the orientation of the male and female bayonet connectors of the bayonet connection may be reversed. More specifically, the outlet fitting 50 of the doser body could be provided with the female bayonet connector, while the proximal end of the dosing arm 52 could be provided with the male bayonet connector.

Figure 15:
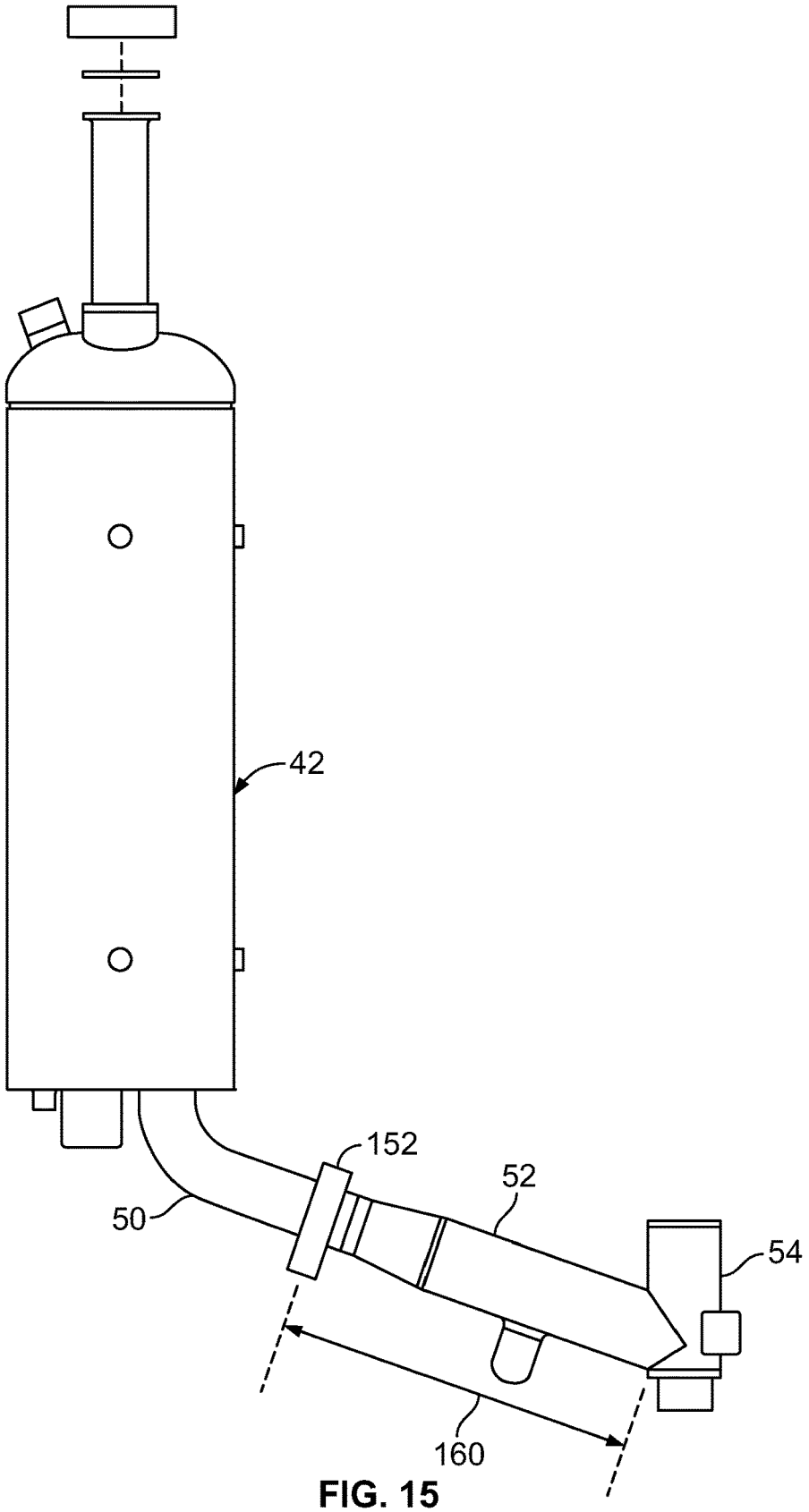
FIG. 15 is a side elevational view of the doser of FIGS. 2, 3 and 13 with the joined and clamped male and female bayonet connectors.

With reference to FIG. 15, the dosing arm 52 has a length indicated by arrows 160. If a user application requires a different length, the clamp 152 may simply be opened, the existing dosing arm removed and a different dosing arm of the same construction, but featuring a different length 160, attached to the doser outlet fitting 150 instead. As examples only, the length 160 may be 15 inches or 22.5 inches.

Using a single dosing body and interchangeable dosing arms makes the doser described above truly modular, and allows it to provide quick, inexpensive custom solutions to address unique situations that users may encounter.

While the preferred embodiments of the disclosure have been shown and described, it will be apparent to those skilled in the art that changes and modifications may be made therein without departing from the spirit of the disclosure, the scope of which is defined by the following claims.

What is claimed is:

1. A doser for dispensing a cryogenic fluid comprising:

a. a doser body including a doser body outer jacket and an inner tank positioned within the doser body outer jacket so that a doser body insulation space is defined therebetween, said space generally evacuated of air, said inner tank including a reservoir configured to receive the cryogenic fluid;

b. an outlet fitting including:

i) an outlet fitting outer jacket;

ii) an outlet fitting inner pipe positioned within the outlet fitting outer jacket, said outlet inner pipe extending from a bottom portion of the inner tank of the doser body and in fluid communication with the doser body reservoir;

iii) an outlet fitting sleeve connected to the outlet fitting outer jacket and inner pipe so that an annular space is defined therebetween;

iv) an outlet fitting flange positioned on the outlet fitting sleeve;

v) a male bayonet insertion stem attached to the outlet fitting sleeve and in fluid communication with the outlet fitting inner pipe;

c. a dosing arm having a proximal end and a distal end, said dosing arm including:

i) a dosing arm outer jacket;

ii) a dosing arm inner pipe positioned within the dosing arm outer jacket and having a central passage;

iii) a dosing arm sleeve connected to the dosing arm outer jacket and inner pipe so that a sealed annular space is defined therebetween, said annular space generally evacuated of air, wherein the dosing arm sleeve and dosing arm outer jacket omit a bellows;

iv) a dosing arm flange positioned on the dosing arm sleeve, said dosing arm flange removably attached to the outlet fitting flange so that the dosing arm is stationary with respect to the doser body when attached;

d. said male bayonet insertion stem removably positioned within and in fluid communication with the central passage of the dosing arm inner pipe; and e. a dosing head mounted to the distal end of the dosing arm and configured to receive cryogenic fluid from the central passage of the dosing arm inner pipe, said dosing head including a dosing valve configured to dispense the cryogenic fluid;

f. a bellows having a first end in fluid communication with the central passage of the dosing arm inner pipe and a second end in fluid communication with the dosing head.

2. The doser of claim 1 wherein the outlet fitting flange is removably attached to the dosing arm flange by a clamp.

3. The doser of claim 1 wherein the outlet fitting flange is removably, attached to the dosing arm flange by fasteners.

4. The doser of claim 1 wherein the cryogenic fluid is liquid nitrogen.

5. The doser of claim 1 further comprising at least one additional dosing head mounted to the distal end of the dosing arm and configured to receive cryogenic fluid from the central passage of the dosing arm and to dispense the cryogenic fluid.

6. The closer of claim 1 wherein the outlet fitting is gooseneck shaped.

* * * * *